US005265527A

United States Patent [19]

Tedford

[11] Patent Number: 5,265,527

[45] Date of Patent: Nov. 30, 1993

[54] OFFSET PRINTING PRESS WITH EMULSIFICATION CONTROL

[75] Inventor: Richard A. Tedford, Strafford, N.H.

[73] Assignee: Harris Graphics Corporation, Dover, N.H.

[21] Appl. No.: 715,377

[22] Filed: Jun. 14, 1991

[51] Int. Cl.[5] ..... B41F 7/26; B41F 31/06

[52] U.S. Cl. ..... 101/148

[58] Field of Search ..... 101/148, 349, 350, 351-352, 101/207-210, 147, 363, 141, 142

[56] References Cited

U.S. PATENT DOCUMENTS

| | | | |
|---|---|---|---|
| 3,467,008 | 1/1967 | Domotor . | |
| 3,724,368 | 4/1973 | Treff . | |
| 3,937,141 | 2/1976 | Dahlgren . | |
| 4,351,236 | 9/1982 | Beisel | 101/148 |
| 4,403,867 | 9/1983 | Duke . | |
| 4,404,908 | 9/1983 | Simeth . | |
| 4,481,882 | 11/1984 | Rudolph | 101/148 |
| 4,677,298 | 6/1987 | Zelmanovic et al. . | |
| 4,703,690 | 11/1987 | Keller | 101/148 |
| 4,724,764 | 2/1988 | MacPhee et al. . | |

*Primary Examiner*—J. Reed Fisher

*Attorney, Agent, or Firm*—Tarolli, Sundheim & Covell

[57] ABSTRACT

An offset lithographic printing press has a source of ink (40), a source of dampening liquid (42), and a first means for transferring and emulsifying ink and dampening liquid. The first means includes a plate cylinder (12) for carrying a printing plate (18). A second means (96 or 150) is selectively actuatable while the plate cylinder (12) is rotating and transferring the image from the printing plate (18) to the material being printed (24). The second means (96 or 150), when actuated, causes the first means to emulsify ink and dampening liquid to minimize undesirable amounts of dampening liquid on the printing plate (18). A third means (100 or 200) selectively actuates the second means (96 or 150) when undesirable amounts of dampening liquid are present on the printing plate (18).

3 Claims, 3 Drawing Sheets

OFFSET PRINTING PRESS WITH EMULSIFICATION CONTROL

FIELD OF THE INVENTION

The present invention relates to an offset printing press, and particularly relates to emulsification of ink and dampening liquid in an offset lithographic printing press.

BACKGROUND OF THE INVENTION

An offset lithographic printing press typically comprises a plate cylinder, an ink form roll and a dampener form roll supported for rotation in the press. The plate cylinder carries a printing plate having a surface defining an image to be printed. The surface of the printing plate has portions which are treated to receive ink and reject dampening liquid, and other portions which are treated to receive dampening liquid and reject ink.

Typically, a succession of inker rolls transfers ink from an ink fountain to the ink form roll. The ink form roll applies a film of the ink to the printing plate surface at a nip between the plate cylinder and the ink form roll. A succession of dampener rolls transfers the dampening liquid from a dampening liquid fountain to the dampener form roll. The dampener form roll applies a film of the dampening liquid to the printing plate surface at a nip between the plate cylinder and the dampener form roll. The press also includes a blanket cylinder which picks up the inked image from the printing plate surface at a nip between the plate cylinder and the blanket cylinder. The blanket cylinder transfers the inked image from the printing plate to the material being printed, such as a moving paper web.

When the ink form roll applies ink to the printing plate surface, it encounters both ink and dampening liquid at the printing plate surface Dampening liquid applied to the printing plate surface by the dampener form roll may be picked up by the ink form roll. Such dampening liquid picked up by the ink form roll can interfere with the application of ink to the material being printed A variety of print defects can occur, such as mottle, stripes, spots, and the like.

SUMMARY OF THE INVENTION

In accordance with the present invention, a printing apparatus for transferring an image from a printing plate to material to be printed includes a source of ink and a source of dampening liquid The printing apparatus also includes a plate cylinder for carrying the printing plate, an inker means for transferring ink from the source of ink to the printing plate, and a dampening means for transferring dampening liquid from the source of dampening liquid to the printing plate. The printing apparatus can be operated to emulsify ink and dampening liquid if desired.

The printing apparatus includes a means which is selectively actuatable while the plate cylinder is rotating to transfer the image from the printing plate to the material being printed. This means, when actuated, causes the printing apparatus to emulsify ink and dampening liquid to minimize undesirable amounts of dampening liquid on the printing plate.

The invention advantageously prevents spots and/or other printing defects when a dampening liquid spot exists on the printing plate surface, because such dampening liquid is emulsified into the ink. The resulting dilution of ink strength is insignificant in terms of printing defects when compared with spots or stripes of dampening liquid that would otherwise remain on the printing plate surface. Importantly, emulsification occurs at selected times during operation of the printing apparatus and while the plate cylinder is rotating and transferring the image from the printing plate to the material being printed. Any amount of emulsification required to avoid printing defects is performed without interrupting or slowing down rotation of the plate cylinder. Wasteful delays and downtime are thus avoided.

In a preferred embodiment of the present invention, the inker means comprises an ink form roll that applies ink to the printing plate surface and a vibrator roll that applies ink to the ink form roll. The emulsification of ink and excess dampening liquid occurs at the nip between the ink form roll and the vibrator roll. The emulsification is caused by changing the rotational surface speed of the vibrator roll relative to the rotational surface speed of the ink form roll.

In another preferred embodiment of the present invention, the emulsification of ink and excess dampening liquid likewise occurs at the nip between the ink form roll and the vibrator roll. The emulsification is caused by changing the size of the nip while the plate cylinder is rotating and transferring the image from the printing plate to the material being printed. The size of the nip is changed by moving the ink form roll radially relative to the vibrator roll.

BRIEF DESCRIPTION OF THE DRAWINGS

Further features of the present invention will become apparent to those skilled in the art to which the present invention relates from reading the following specification with reference to the accompanying drawings, wherein.

DESCRIPTION OF PREFERRED EMBODIMENTS

Figure 1:
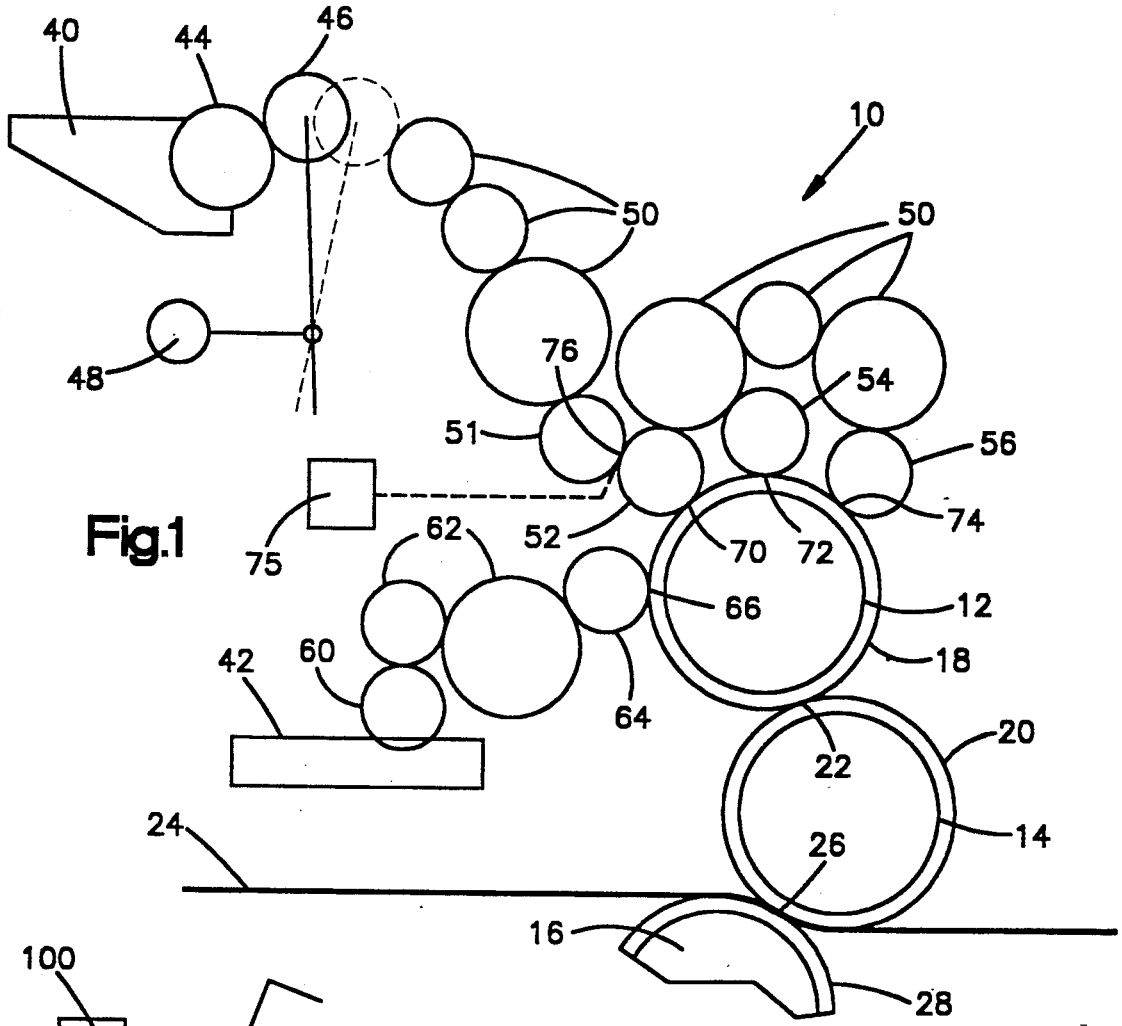
FIG. 1 is a schematic view of a printing press constructed in accordance with the present invention.

A printing press constructed in accordance with the present invention is shown schematically in FIG. 1. The printing press 10, by way of example, is an offset lithographic printing press including a plate cylinder 12, a blanket cylinder 14, and an impression cylinder 16. The plate cylinder 12 carries a printing plate 18 having a surface defining an image to be printed. The blanket cylinder 14 carries a printing blanket 20 which picks up the inked image from the printing plate 18 at the nip 22 between the plate cylinder 12 and the blanket cylinder 14. The printing blanket 20 subsequently transfers the inked image to the material being printed, preferably a web 24 moving through the nip 26 between the blanket cylinder 14 and the impression cylinder 16. As shown in FIG. 1, the impression cylinder 16 is a second blanket cylinder carrying a second printing blanket 28 for printing simultaneously on the opposite side of the web 24.

The printing press 10 further includes an ink fountain 40 and a dampening liquid fountain 42. An ink fountain roll 44 picks up ink from the ink fountain 40. A ductor roll 46 is reciprocated between the ink fountain roll 44 and a first ink distributor roll 50 by a reciprocating motor 48. The ductor roll 46 thus transfers ink from the ink fountain roll 44 to the first ink distributor roll 50. Successive ink distributor rolls 50, including a vibrator roll 51, further transfer the ink from the first ink distributor roll 50 to a group of ink form rolls 52, 54 and 56. The ink form rolls 52, 54 and 56 each carry a continuous film of ink, and apply the ink to the surface of the printing plate 18 on the plate cylinder 12.

A dampener fountain roll 60 picks up dampening liquid from the dampening liquid fountain 42 Dampener distributor rolls 62 transfer the dampening liquid from the dampener fountain roll 60 to a dampener form roll 64. The dampener form roll 64 carries a continuous film of dampening liquid, and applies the dampening liquid to the surface of the printing plate 18.

The image to be printed is defined on the surface of the printing plate 18 by surface portions that are treated to receive ink and reject dampening liquid, and by other surface portions that are treated to receive dampening liquid and reject ink When the printing plate 18 moves through the nip 66 between the plate cylinder 12 and the dampener form roll 64, the surface portions of the printing plate 18 that are receptive to dampening liquid pick up dampening liquid from the continuous film on the dampener form roll 64. When the printing plate 18 moves through the nips 70, 72 and 74 between the plate cylinder 12 and the ink form rolls 52, 54 and 56, the surface portions of the printing plate 18 that are receptive to ink pick up ink from the continuous films on the ink form rolls 52, 54 and 56. An inked image is thus formed on the surface of the printing plate 18.

Figure 2:
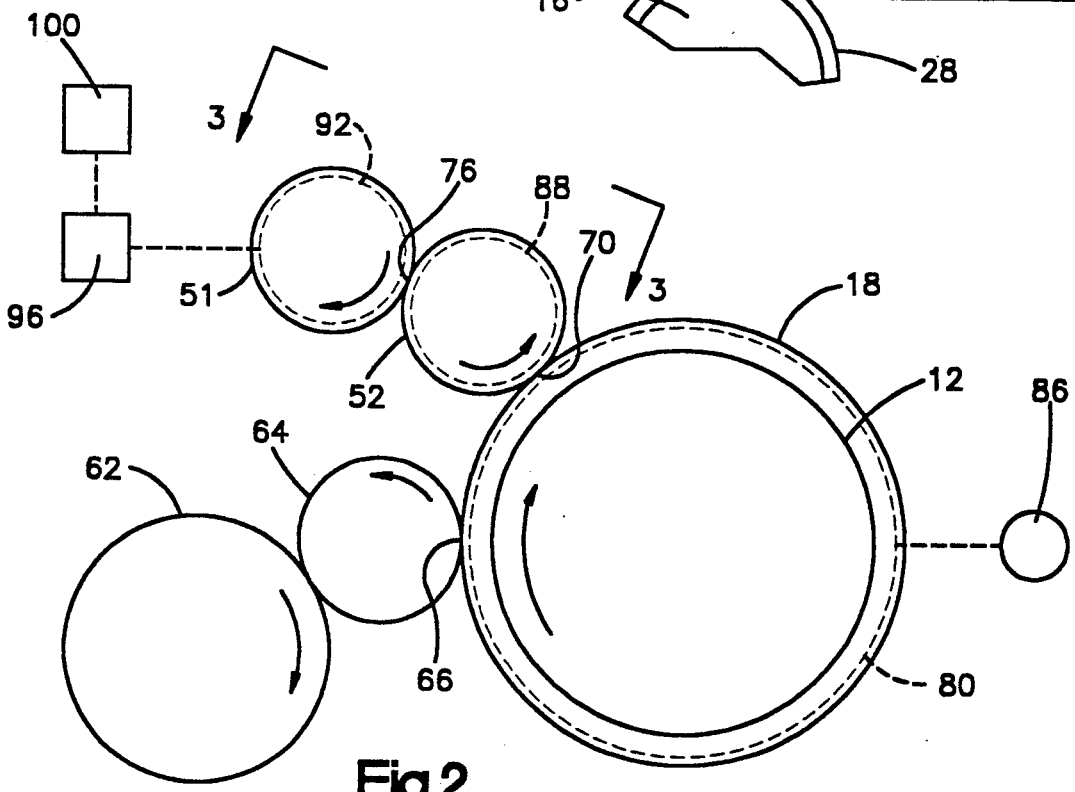
FIG. 2 is a schematic view of a portion of the printing press of FIG. 1.

As shown in FIG. 2, the surface of the printing plate 18 moves through the nip 66 between the plate cylinder 12 and the dampener form roll 64, and subsequently moves through the nip 70 between the plate cylinder 12 and the ink form roll 52. When the surface of the ink form roll 52 moves through the nip 70, it encounters both ink and dampening liquid on the surface of the printing plate 18. If, for example, an excess amount of dampening liquid is applied to the surface of the printing plate 18 by the dampener form roll 64 at the nip 66, the ink form roll 52 will encounter the excess dampening liquid at the nip 70. The excess dampening liquid can be picked up by the ink form roll 52 and returned to the surface of the printing plate 18 at a portion thereof which subsequently moves through the nip 70. The excess dampening liquid can result in printing defects on the web such as mottle, stripes or water spots. In order to prevent mottle, stripes, water spots and other printing defects caused by such excess dampening liquid, the printing press 10 can be operated to emulsify the ink and dampening liquid.

The printing press 10 includes a emulsification control mechanism 75 for controlling emulsification of ink and dampening liquid, preferably at the nip 76 between the ink form roll 52 and the vibrator roll 51. FIGS. 2-5 show parts of the printing press 10 including a first embodiment of the emulsification control mechanism 75. In this embodiment, emulsification of ink and dampening liquid at the nip 76 is caused by changing the rotational surface speed of the vibrator roll 51 relative to the rotational surface speed of the ink form roll 52 while the plate cylinder 12 is rotating and transferring the inked image to the moving web 24.

Figure 3:
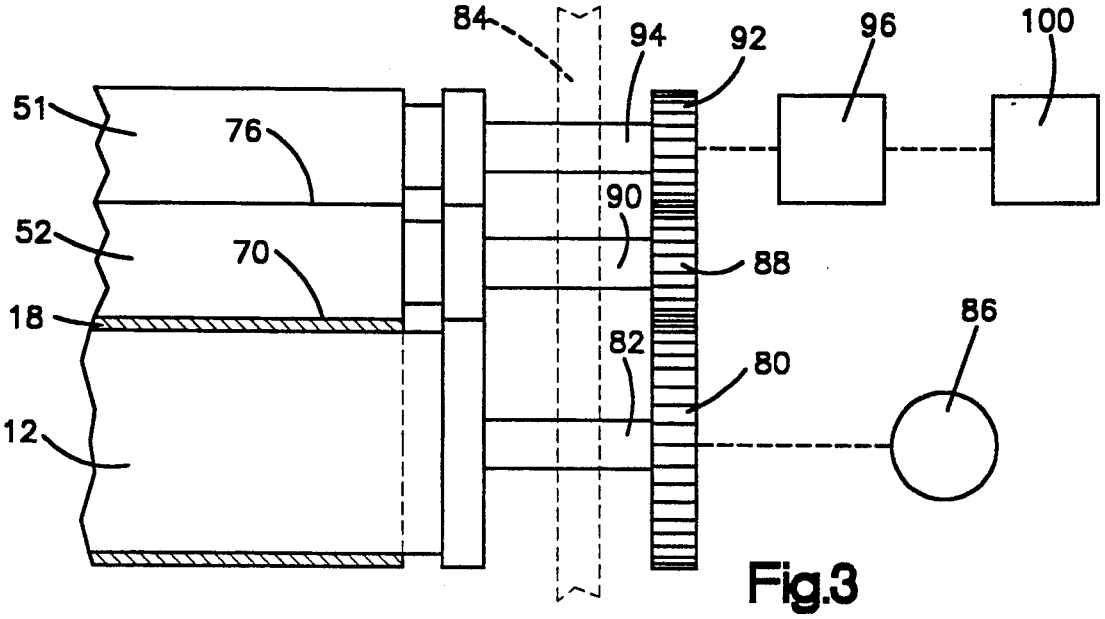
FIG. 3 is a schematic view taken on line 3—3 of FIG. 2.

As shown schematically in FIGS. 2 and 3, the printing press 10 includes a plurality of gears and motors for rotating the rolls and cylinders. A first gear 80 is fixed to the plate cylinder 12 by a shaft 82 extending through a supporting frame 84. The first gear 80 and the plate cylinder 12 are thus connected to rotate together, and are driven by a motor 86. A second gear 88 is fixed to the ink form roll 52 by a shaft 90 extending through the frame 84. The second gear 88 meshes with the first gear 80. The ink form roll 52 is rotated by the first and second gears 80 and 88 with a surface speed equal to the surface speed of the printing plate 18 carried on the plate cylinder 12.

A third gear 92 meshes with the second gear 88. The third gear 92 has a greater pitch diameter and a greater number of gear teeth than the second gear 88. The third gear 92 therefore rotates at a speed less than the speed of the second gear 88.

A shaft 94 is fixed to the vibrator roll 51. If the third gear 92 were fixed to the shaft 94, the vibrator roll 51 would be rotated by the third gear 92 with a surface speed that is always less than the surface speed of the ink form roll 52. However, the third gear 92 is connected to the shaft 94 through a harmonic drive unit 96. The harmonic drive unit 96 enables the shaft 94 and the vibrator roll 51 to rotate in response to rotation of the third gear 92, and to rotate relative to the third gear 92. The harmonic drive unit 96 enables the vibrator roll 51 to rotate with a surface speed that is less than, equal to, or greater than the surface speed of the ink form roll 52. Operation of the harmonic drive unit 96 is controlled by a manually operated controller 100.

Figure 4:
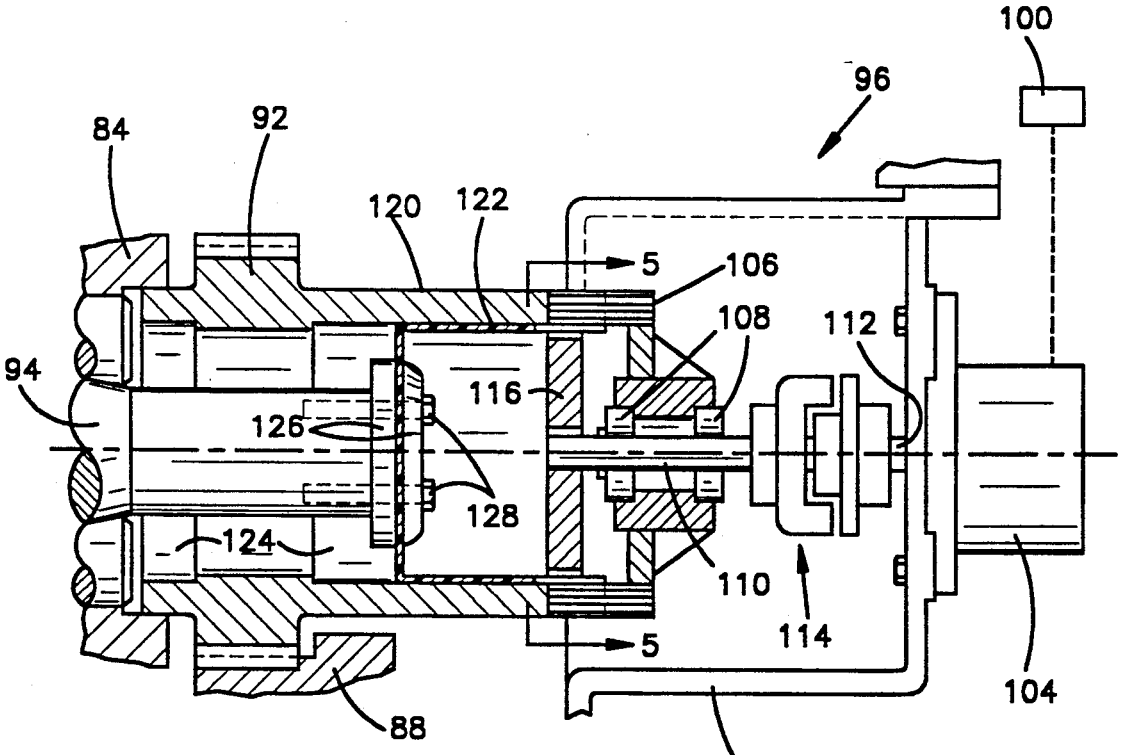
FIG. 4 is a partial view of parts of the printing press shown in FIG. 3.
Figure 5:
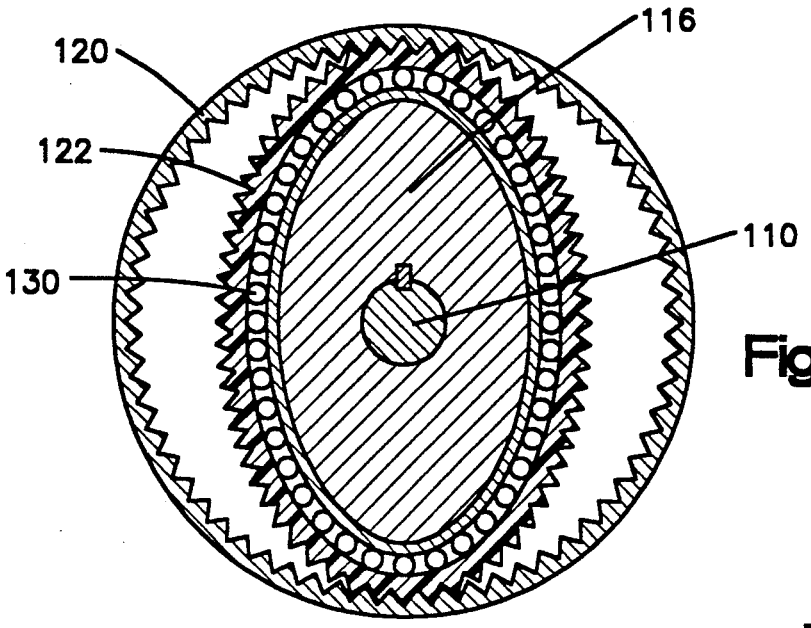
FIG. 5 is a view taken on line 5—5 of FIG. 4.

FIGS. 4 and 5 show the harmonic drive unit 96 in detail. As shown in FIG. 4, the harmonic drive unit 96 includes a housing 102 and a motor 104. The housing 102 has an internal support structure 106 including bearings 108. A shaft 110 is supported for rotation in the bearings 108, and is connected to the output shaft 112 of the motor 104 by a coupling assembly 114. A wave generator 116 is keyed to the shaft 110 to rotate with the shaft 110.

The harmonic drive unit 96 further includes an input member 120 and an output member 122. The input member 120 is a cylindrical projection on the third gear 92. The input member 120 and the third gear 92 are supported by bearings 124 to rotate relative to the shaft 94 and the vibrator roll 51. The output member 122 is firmly clamped between a pair of plates 126 which are fixed to the shaft 94 by bolts 128. The output member 122 rotates the shaft 94 and the vibrator roll 51. The input member 120 and the output member 122 are thus supported to rotate relative to each other.

As shown in FIG. 5, the output member 122 is a flexible elliptical member having external gear teeth meshing with internal gear teeth on the input member 120. The output member 122 also has an inner surface supported by roller bearings 130 to rotate relative to the wave generator 116. When the wave generator 116 is stationary and the input member 120 rotates, the output member 122 is rotated at a speed greater than the speed of the input member 120 because the output member 122 has fewer gear teeth than the input member 120. When the wave generator 116 rotates at the same speed as the input member 120, the output member 122 is also rotated at the same speed as the input member 120. A difference in speed between the input member 120 and the output member 122 is thus related to a difference in speed between the input member 120 and the wave generator 116. Harmonic drive units like the harmonic drive unit 96 are known in the art. One such harmonic drive unit is disclosed in U.S. Pat. No. 3,724,368.

In operation of the printing press 10, the wave generator 116 is normally stationary. The third gear 92 and the input member 120 are rotated by the second gear 88 at a speed less than the speed of the second gear 88 and the ink form roll 51. The output member 122 is rotated by the input member 120 at a speed greater than the speed of the input member 120. The difference in speeds between the output member 122 and the input member 120 is such that the output member 122 normally rotates the vibrator roll 51 with a surface speed equal to the surface speed of the ink form roll 52.

Figure 6:
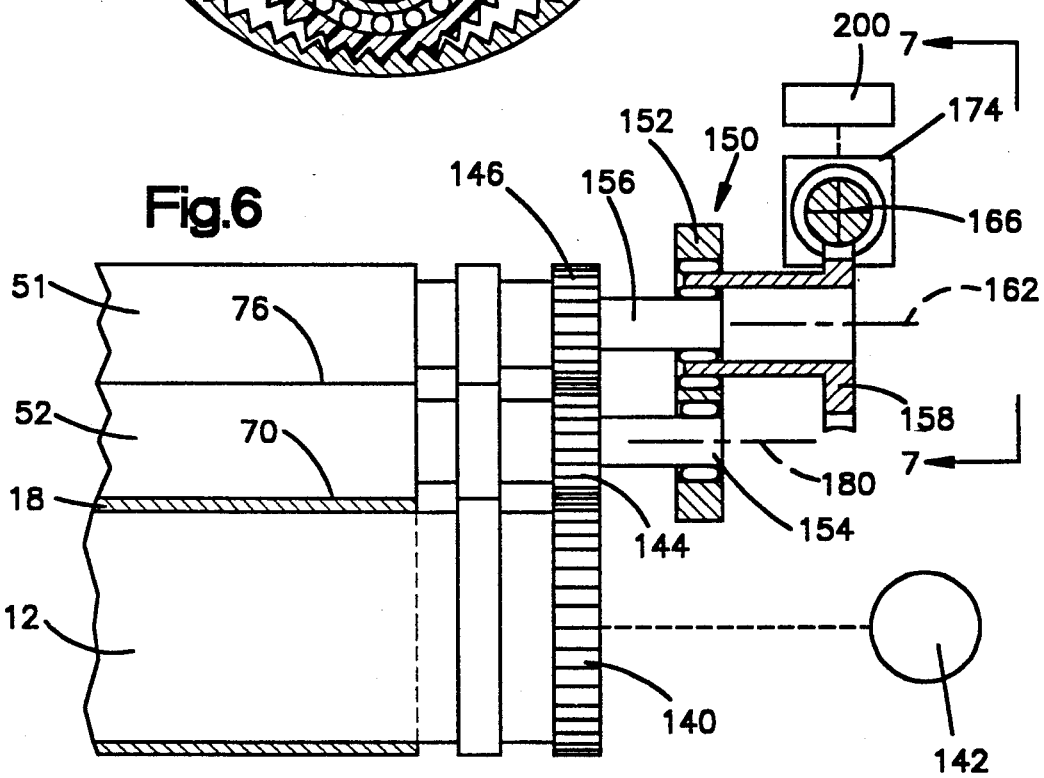
FIG. 6 is a schematic view of a portion of a printing press constructed in accordance with an alternate embodiment of the invention.
Figure 7:
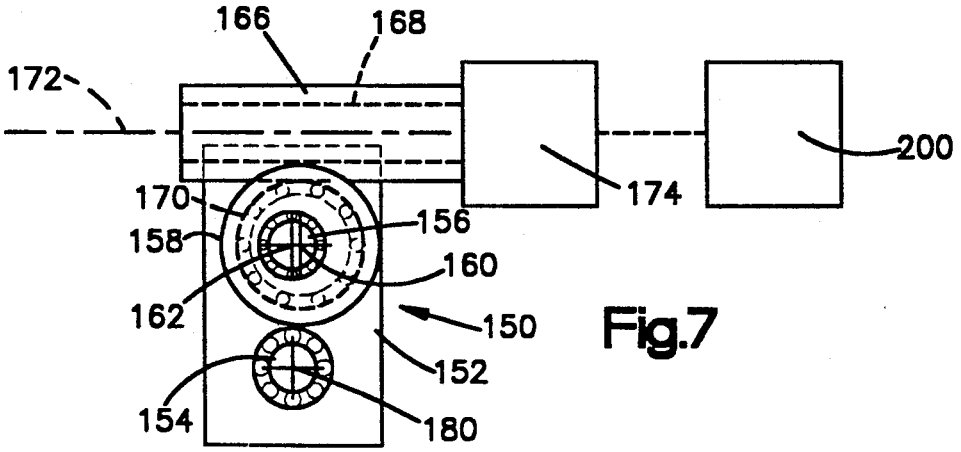
FIG. 7 is a schematic view taken on line 7—7 of FIG. 6.

If the operator of the printing press 10 desires to change the surface speed of the vibrator roll 51 relative to the surface speed of the ink form roll 52 in order to emulsify ink and dampening liquid at the nip 76, a change in the surface speed of the vibrator roll 52 can be made with the manually operated controller 100. The manually operated controller 100 controls rotation of the shaft 110 and the wave generator 116 by the motor 104. The manually operated controller 100 thereby controls the difference in speed between the input member 120 and the output member 122, and in turn, controls the difference in surface speed between the vibrator roll 51 and the ink form roll 52. The amount of dampening liquid emulsified with the ink at the nip 76 is increased by increasing the difference in surface speeds between the vibrator roll 51 and the ink form roll 52, and is decreased by decreasing the difference in surface speeds. Blotches and stripes of excess dampening liquid and/or the resulting printing defects observed b the operator of the printing press 10 are eliminated by using the manually operated controller 100 accordingly. Importantly, rotation of the plate cylinder 12 is not affected by the manually operated controller 100. Spots and stripes of dampening liquid can therefore be eliminated by controlled emulsification at any time during the printing process while the plate cylinder 12 is rotating and without interrupting the printing process FIGS. 6 and 7 show parts of the printing press 10 including a second embodiment of the emulsification control mechanism 75. In this embodiment, emulsification of ink and dampening liquid at the nip 76 is caused by changing the size of the nip 76 while the plate cylinder 12 is rotating and transferring the inked image to the moving paper web 24.

As shown schematically in FIG. 6, a first gear 140 is fixed to the plate cylinder 12 and is rotated by a motor 142. A second gear 144 is fixed to the ink form roll 52. The second gear 144 meshes with the first gear 140 and with a third gear 146 fixed to the vibrator roll 51. The ink form roll 52 and the vibrator roll 51 are thus rotated by the motor 142 with a surface speed equal to the surface speed of the printing plate 18 carried on the plate cylinder 12.

As shown schematically in FIGS. 6 and 7, a linkage 150 including a link 152 connects the ink form roll 52 with the vibrator roll 51. The ink form roll 52 has a stub shaft 154 which rotates relative to the link 152. The vibrator roll 51 has a stub shaft 156 which rotates relative to the link 152, and which also rotates relative to an eccentric ring 158. The eccentric ring 158 rotates relative to the stub shaft 156 and the link 152. The eccentric ring 158 has a central axis 160 (FIG. 7), and rotates about the central axis 162 of the stub shaft 156.

A worm gear 166 has gear teeth 168 meshing with gear teeth 170 on the eccentric ring 158, and is supported for rotation about an axis 172. The worm gear 166 is rotated by a motor 174 which is controlled by a manually operated controller 200. When the worm gear 166 rotates about the axis 172 with the gear teeth 168 in meshing engagement with the gear teeth 170, the eccentric ring 158 is rotated about the axis 162.

When the eccentric ring 158 rotates about the axis 162, its central axis 160 moves in an arcuate path about the axis 162. The eccentric ring then moves the link 152 vertically upward or downward as shown in FIG. 7, and thus moves the axis 180 of the stub shaft 154 either upward or downward relative to the axis 162 of the stub shaft 156. The ink form roll 52 is thus moved either toward or away from the vibrator roll 51.

When the ink form roll 52 is moved toward the vibrator roll 51, the flexible surfaces of those rolls are pressed together to a greater degree. The nip 76, as shown in FIGS. 1 and 2, becomes wider in the circumferential direction, and the pressure in the ink and dampening liquid moving through the nip 76 is increased. The increased width and pressure at the nip 76 cause a corresponding increase in emulsification of the dampening liquid and the ink. Movement of the ink form roll 52 away from the vibrator roll 51 likewise results in a decrease in emulsification at the nip 76. As with the first embodiment described above, excess dampening liquid and the resulting printing defects are eliminated by using the manually operated controller 200 while the plate cylinder 12 is being rotated to transfer the image from the printing plate 18 to the blanket cylinder 14 and the moving web 24.

From the above description of the invention, those skilled in the art will perceive improvements, changes and modifications. Such improvements, changes and modifications within the skill of the art are intended to be covered by the appended claims.

Having described the invention, the following is claimed:

1. A printing apparatus for transferring ink and dampening liquid onto a printing plate, said printing apparatus comprising:

a source of ink (40);

a source of dampening liquid (42);

dampening means (60–64) for transferring dampening liquid from said source of dampening liquid (42) onto the printing plate (18);

first means for transferring ink and dampening liquid and for emulsifying ink and dampening liquid, said first means including a plate cylinder (12) for carrying the printing plate (18) and inker rolls (44–56) for transferring ink from said source of ink (40) onto the printing plate (18), said inker rolls (44–56) defining a plurality of nips (70–76), said first means moving both ink and dampening liquid through at least one of said nips (70–76) while said inker rolls (44–56) are transferring ink onto the printing plate (18);

said printing apparatus being characterized by:

second means (150) for emulsifying ink and dampening liquid to minimize undesirable amounts of dampening liquid on the printing plate (18) when said second means (150) is operating, said second means (150) being selectively actuatable and operable while said dampening means (60–64) is transferring dampening liquid onto the printing plate (18) and said inker rolls (44–56) are simultaneously transferring ink onto the printing plate (18), said second means (150) changing the size of one of said nips (70–76) when operating; and third means (200) for selectively actuating and operating said second means (150) to a desired degree to cause a desired degree of emulsification while said dampening means (60–64) is transferring dampening liquid onto the printing plate (18) and said inker rolls (44–56) are simultaneously transferring ink onto the printing plate (18), said third means (200) being manually operable by an operator of said printing apparatus.

2. A printing apparatus as defined in claim 1 wherein said inker rolls (44–56) include an ink form roll (52) for transferring ink onto the printing plate (18) and an adjacent inker roll (51) for transferring ink onto said ink form roll (52), said second means (150) changing the distance between the axes (180, 162) of said ink form roll (52) and said adjacent inker roll (51) when operating.

3. A printing apparatus as defined in claim 2 wherein said second means (150) moves the axis of said ink form roll (52) when operating.

* * * * *